US005158180A

United States Patent [19]

Zucker

[11] Patent Number: 5,158,180

[45] Date of Patent: Oct. 27, 1992

[54] WET TISSUE DISPENSER

[75] Inventor: Shlomo Zucker, Michmoret, Israel

[73] Assignee: Product Development (Z.G.S.) Ltd., Petach Tikva, Israel

[21] Appl. No.: 650,711

[22] Filed: Feb. 4, 1991

[30] Foreign Application Priority Data

Feb. 4, 1990 [IL] Israel ..... 093267

[51] Int. Cl.[5] ..... B65D 85/67

[52] U.S. Cl. ..... 206/409; 206/210; 221/63; 220/253

[58] Field of Search ..... 206/210, 409, 494, 812, 206/233; 221/63; 220/345, 352, 356, 353, 253

[56] References Cited

U.S. PATENT DOCUMENTS

| | | | |
|---|---|---|---|
| 1,013,715 | 1/1912 | Yuste et al. | 206/409 X |
| 2,075,776 | 3/1937 | Barnby . | |
| 2,328,246 | 8/1943 | Albion | 220/253 X |
| 2,790,576 | 4/1957 | Lawrence | 220/356 |
| 3,152,691 | 10/1964 | Hultgren | 220/352 X |
| 3,843,017 | 10/1974 | Harrison | 206/210 X |
| 3,973,695 | 8/1976 | Ames | 221/63 |
| 4,171,047 | 10/1979 | Doyle et al. | 206/210 |
| 4,180,160 | 12/1979 | Ogawa et al. | 221/63 X |
| 4,181,218 | 1/1980 | Cox | 221/63 X |
| 4,219,129 | 8/1980 | Sedwick | 206/409 X |
| 4,651,895 | 3/1987 | Niske et al. | 221/63 |

FOREIGN PATENT DOCUMENTS

| | | | |
|---|---|---|---|
| 0030506 | 6/1981 | European Pat. Off. | 221/63 |
| 84922 | 3/1983 | European Pat. Off. . | |
| 8804841 | 6/1988 | Fed. Rep. of Germany . | |
| 1016474 | 11/1952 | France | 206/409 |
| 0221761 | 9/1924 | United Kingdom | 206/409 |
| 2024160 | 9/1980 | United Kingdom . | |

*Primary Examiner*—Paul T. Sewell
*Assistant Examiner*—Ted Kavanaugh
*Attorney, Agent, or Firm*—Browdy and Neimark

[57] ABSTRACT

A closable dispenser of wet tissues is described where the tissue edge is protected from drying out when not in use. The wet tissue is fed between the container lip and lid with the lid being rotatable to protect the tissue from exposure when not in use.

5 Claims, 3 Drawing Sheets

WET TISSUE DISPENSER

This invention relates to a dispenser of wet tissues.

BACKGROUND OF THE INVENTION

Wet tissues made of non woven napkins soaked with a perfumed wetting media have been used for many years. In the past the tissues were usually packed in aluminum foil sealed packages which protected the tissues from losing the moisture into the surrounding.

Lately dispensing devices were introduced to enable multiple tissues to be stored in a container, thus protected from loss of moisture, and dispensing techniques were introduced in the lid of the container enabling the user to pull out each tissue separately, without having the need to open the lid, thus keeping the tissues with the original (or close to the original) moisture content. The problem that arose with the available lid is that their design is cumbersome and expensive to produce; and the technique of releasing the tissue always results a dried up edge, as the edge is exposed to the open air continuously, the dried up edge may eventually result in loosing more moisture from the moist tissues in the container by a capillary effect.

Also, the release of the first tissue which is done by the manufacturer of the tissue dispenser system is extremely difficult, because the operator has to enter with a tubular pin, through a little hole in the lid and fish out the wet tissue edge.

It is the purpose of this invention to provide dispensing means which will be cheap and simple to manufacture; and will protect the wet tissue at all times from loss of moisture, will be simple for the operator to dispense the first tissue, without having the need to search and fish out an edge through a hole in the lid.

BRIEF DESCRIPTION OF THE INVENTION

The dispenser herein provided comprises a container having a circular neck, through which the contents can be withdrawn; and having on the lip of said neck a section inclined inwards towards the center; and having a circular lid to fit onto said container's neck having a cut out window relating to said inclined section of said container's lip, so that wet tissue stored in said container can be pulled out when said window in the lid is positioned exactly opposite said inclined neck lip section; and when said lid is turned into any other position, the wet tissues edge reaching over said inclined lip section is protected.

In the preferred embodiment said neck lip of the container is provided with a plurality of protrusions along its circumference; and said lid edge is provided with an equal number of protrusions on its inner edge circumference. So that when said lid is placed on said neck lip, in a position where the protrusions of both neck and lid come into contact the lid closure improves, and prevents escape of moisture from the exposed edge of the wet tissue.

In one preferred embodiment said cut out window in said lid is cut out completely till the lid ending in an inverted U form.

In another preferred embodiment said cut out window in said lid is cut out, leaving a closed lip of the lid in either a square or circular form.

In the preferred embodiment both container and lid are produced from pliable plastic material being a relatively good barrier to moisture.

In the preferred embodiment the container and lid are made of polypropylene, or high density polyethylene, which are good barriers to moisture.

The invention can be best understood according to the attached drawings.

DETAILED DESCRIPTION OF THE INVENTION

Figure 1:
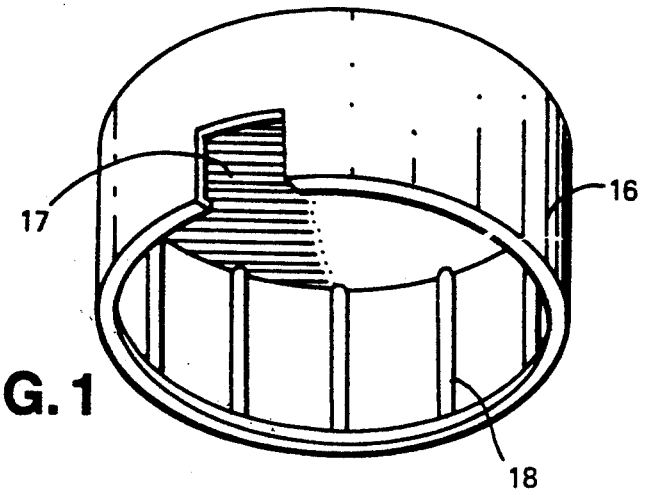
FIG. 1 illustrates the perspective view of the lid.
Figure 2:
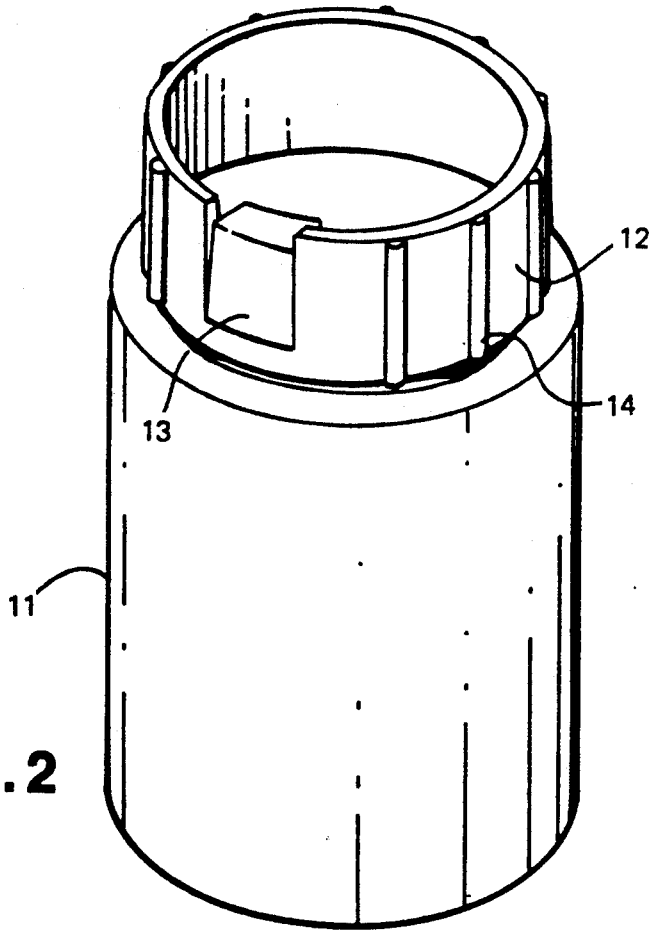
FIGS. 2 and 3 illustrate a perspective view of the container without and with a wet tissue.
Figure 3:
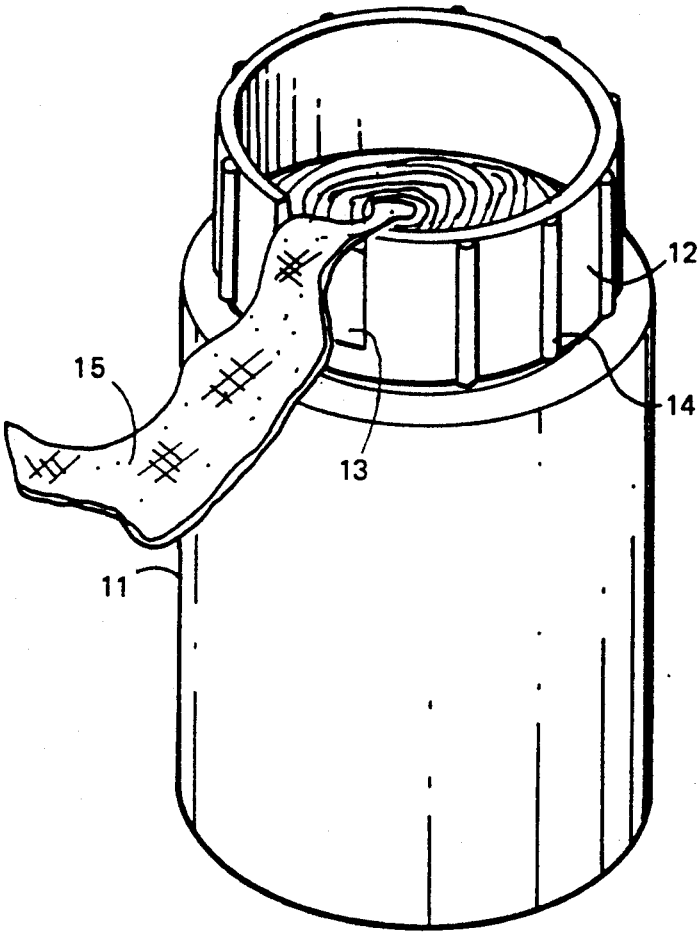

As shown in FIGS. 1, 2 and 3 the container 11, has a neck lip 12 with protrusions 14 along its circumference, and a section 13 inclined inwards. A tissue 15 slides out over section 13. The lid 16 has a window 17 cut out on its edge, and has protrusions 18 on its inner edge.

Figure 4:
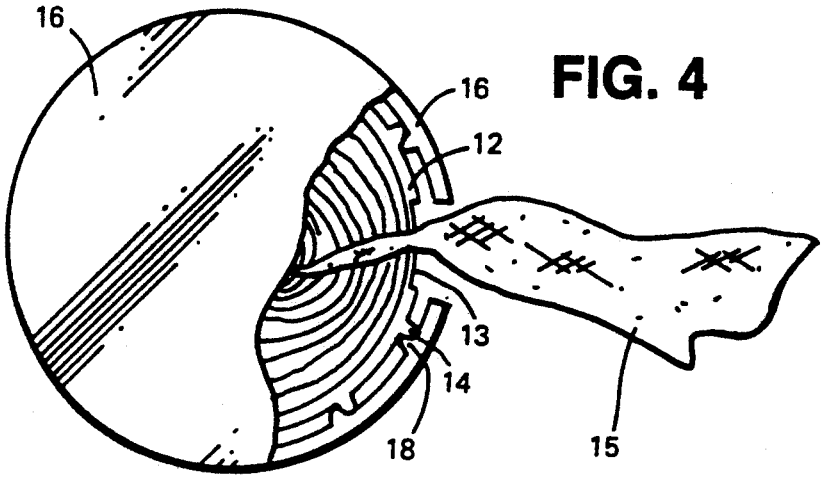
FIG. 4 illustrates a top view of the lid and container.
Figure 5:
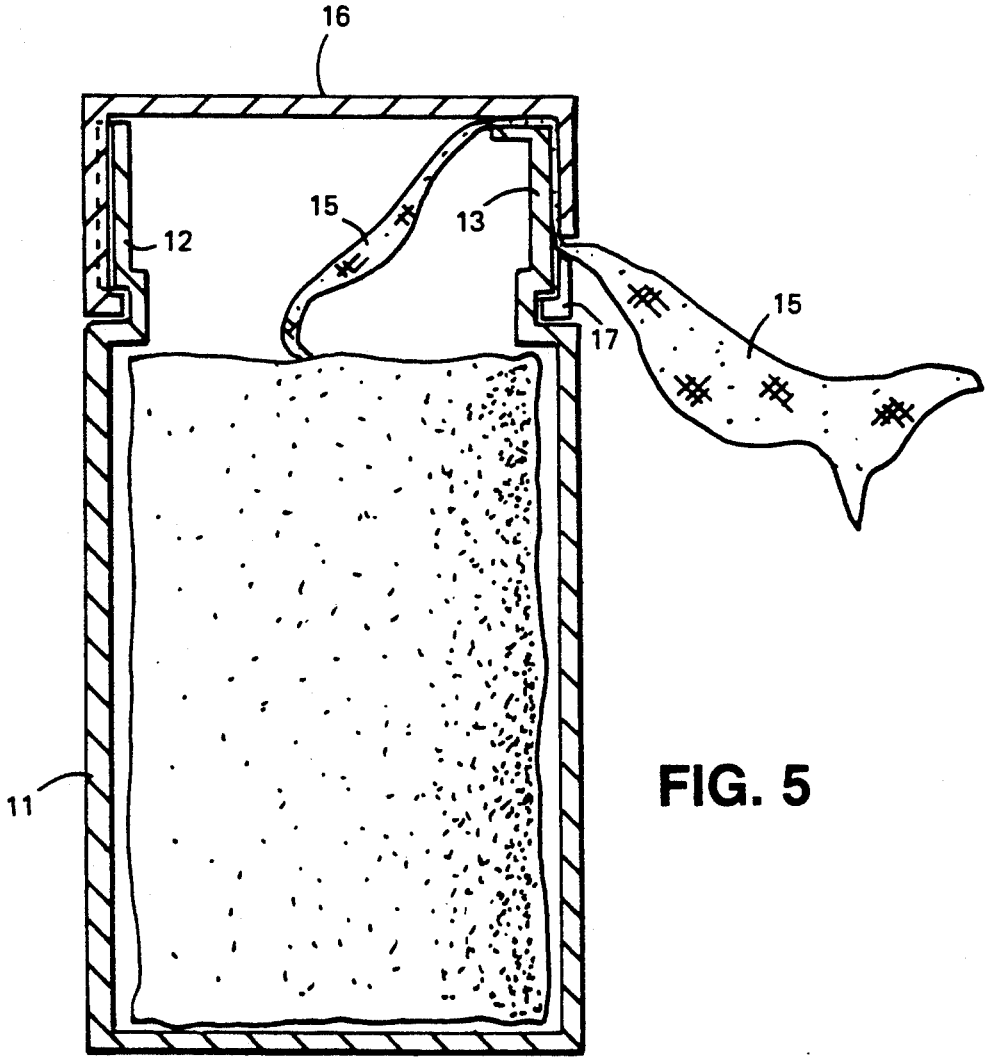
FIG. 5 illustrates a cross sectional view of the container and lid.

FIGS. 4 and 5 illustrate a top view and cross section of both the container 11 and lid 16. The container's neck lip 12, has a section 13 inclined inwards, over which the tissue 15 is slid, out of the lid through the cut out window 17 of the lid 16.

Figure 6:
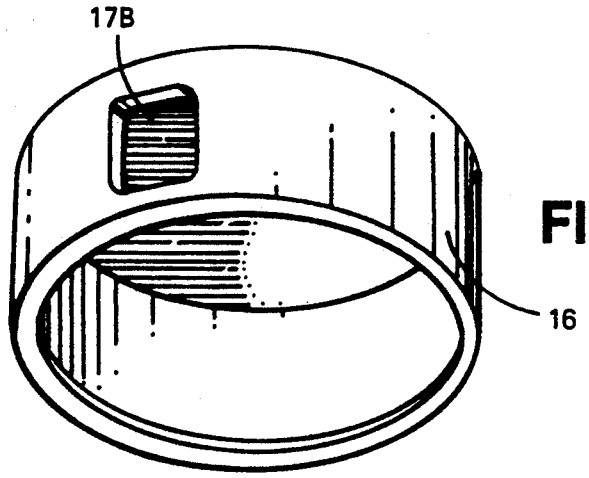
FIG. 6 illustrates a lid having a cut of window cut at a higher position of the lid.

FIG. 6 illustrates a lid 16 having a window 17B placed at a higher position of the lid lip.

The protrusions 14 on the container's neck 12, and 18 on the inner edge of the lip 16 cause enclosures which protect the tissue edge 15 when the lid 16 is turned, and the inclined section 13, in not coinciding with the window 17 or 17B of the lid 16.

What is claimed is:

1. A dispenser for wet tissues comprising a container having a circular neck, through which the contents are withdrawn; having on a top end of said neck, an inclined lip section, inclined inwards towards the center; and having a circular lid to fit on to said container's neck, having a cut out window relating to said inclined lip section of said container's neck lip; so that wet tissues stored in said container can be pulled out of said container, when said window in said lid is positioned exactly opposite said inclined lip section; and when said lid is turned into any other position the edge of the wet tissue reaching over said inclined lip section is protected.

2. A dispenser as in claim 1 wherein said neck lip of said container is provided with a plurality of protrusions along said lip's circumference: and said lid edge is provided with an equal number of protrusions along its circumference; so that when said lid is placed on said neck lip in a position where said protrusions in said lid and neck come into contact, the lid closure of said container is tightened and prevents escape of moisture from the exposed edge of said wet tissue.

3. A dispenser as in claim 1 wherein said window in said lid is cut out at a position leaving a portion of the lid below it.

4. A dispenser as in claim 1 wherein said container and lid are produced from pliable plastic material, being a good barrier to moisture.

5. A dispenser as in claim 3 wherein plastic material is polypropylene or high density polyethylene.

* * * * *